US005884457A

United States Patent [19]

Ortiz et al.

[11] Patent Number: 5,884,457

[45] Date of Patent: Mar. 23, 1999

[54] METHOD AND APPARATUS FOR AUTOMATICALLY PRODUCING A PLURALITY OF STERILE LIQUID FILLED DELIVERY DEVICES

[75] Inventors: Jose A. Ortiz, Telford; Kenneth J. Sylvester, Churchville, both of Pa.

[73] Assignee: SmithKline Beecham Corporation, Philadelphia, Pa.

[21] Appl. No.: 792,352

[22] Filed: Feb. 5, 1997

[51] Int. Cl.[6] ..... B65B 3/00

[52] U.S. Cl. ..... 53/468; 53/167; 53/281; 53/282; 53/81.4; 53/471; 53/492

[58] Field of Search ..... 53/281, 282, 381.4, 53/468, 471, 492, 284.5, 381.2, 284.6, 425, 426, 167

[56] References Cited

U.S. PATENT DOCUMENTS

| | | | |
|---|---|---|---|
| 2,530,230 | 11/1950 | Cozzoli . | |
| 2,749,688 | 4/1956 | Cozzoli . | |
| 2,765,606 | 10/1956 | Brown | 53/282 X |
| 2,823,500 | 2/1958 | Brown | 53/282 X |
| 2,955,393 | 10/1960 | Müller et al. . | |
| 3,245,194 | 4/1966 | Carski | 53/282 X |
| 3,247,641 | 4/1966 | Ridley | 53/282 X |
| 3,470,671 | 10/1969 | Gettig et al. | 53/282 X |
| 3,599,389 | 8/1971 | Hartman . | |
| 3,662,517 | 5/1972 | Tascher et al. . | |
| 3,708,945 | 1/1973 | Klettke | 53/471 |
| 3,791,009 | 2/1974 | Gess | 53/282 X |
| 3,807,119 | 4/1974 | Shields | 53/471 |
| 3,807,131 | 4/1974 | Samson et al. | 53/281 |
| 3,807,467 | 4/1974 | Tascher et al. | 53/282 X |
| 3,835,897 | 9/1974 | Gess | 141/98 |
| 3,940,909 | 3/1976 | Cioni et al. . | |
| 4,501,306 | 2/1985 | Chu et al. | 141/94 |
| 4,628,969 | 12/1986 | Jurgens, Jr. et al. . | |
| 4,703,781 | 11/1987 | Meyer et al. | 141/95 X |
| 4,713,925 | 12/1987 | Kafkis . | |
| 4,718,463 | 1/1988 | Jurgens Jr. et al. . | |
| 4,969,915 | 11/1990 | Hatanaka et al. . | |
| 5,265,956 | 11/1993 | Nelson et al. . | |
| 5,373,684 | 12/1994 | Vacca . | |
| 5,390,469 | 2/1995 | Shimizu et al. . | |
| 5,554,128 | 9/1996 | Hedges . | |
| 5,785,098 | 7/1998 | Sern et al. . | |

OTHER PUBLICATIONS

Baxa Corporation brochure for Baxa Repeater Pump, 4 pages.

CP Packaging brochure for Packaging Machinery, 2 pages.

Design Components Inc. brochure for *Controls & Motor Drives,* including DI400P Microstepping Controller and others, pp. 54–56.

Design Components Inc. brochure for Commercial Economy EC6 Series, Ball Rail, 1 page.

*Primary Examiner*—Daniel B. Moon

*Attorney, Agent, or Firm*—Panitch Schwarze Jacobs & Nadel, P.C.

[57] ABSTRACT

A method of automatically producing a plurality of prefilled, sterile delivery devices with a desired quantity of fluid. The sterile delivery devices each include a hollow barrel with a dispensing nozzle at one end and an open opposite end. A piston plunger is positioned within the open end and is slidable in sealing engagement with the barrel to retain a fluid therein. A tip is secured to the dispensing nozzle. A plurality of the sterile delivery devices are automatically fed along a predetermined path. Tips are then removed from the dispensing nozzles of the sterile delivery devices. The hollow barrels of the sterile delivery devices are then filled through the dispensing nozzles with a desired is quantity of fluid. The dispensing nozzles of the sterile delivery devices are then closed and sealed after the filling step to provide sealed sterile delivery devices with sterile fluid contents.

21 Claims, 13 Drawing Sheets

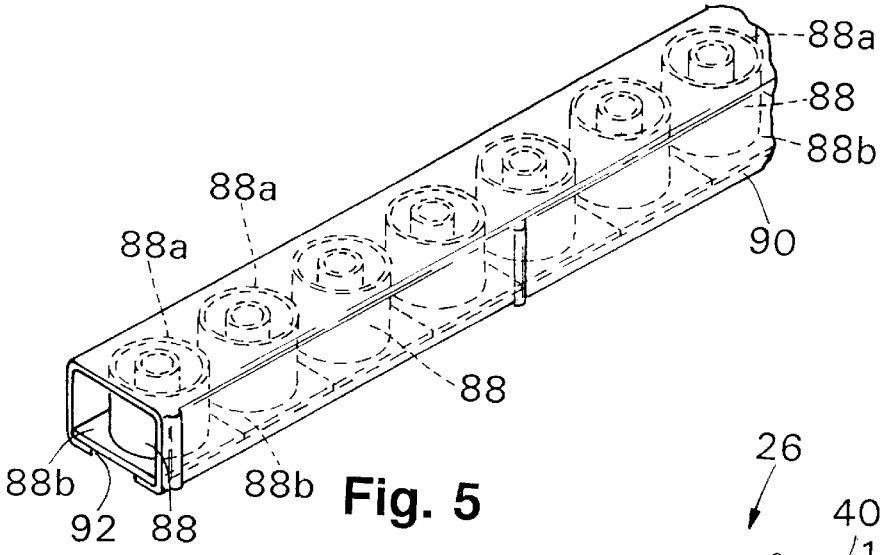
Fig. 5
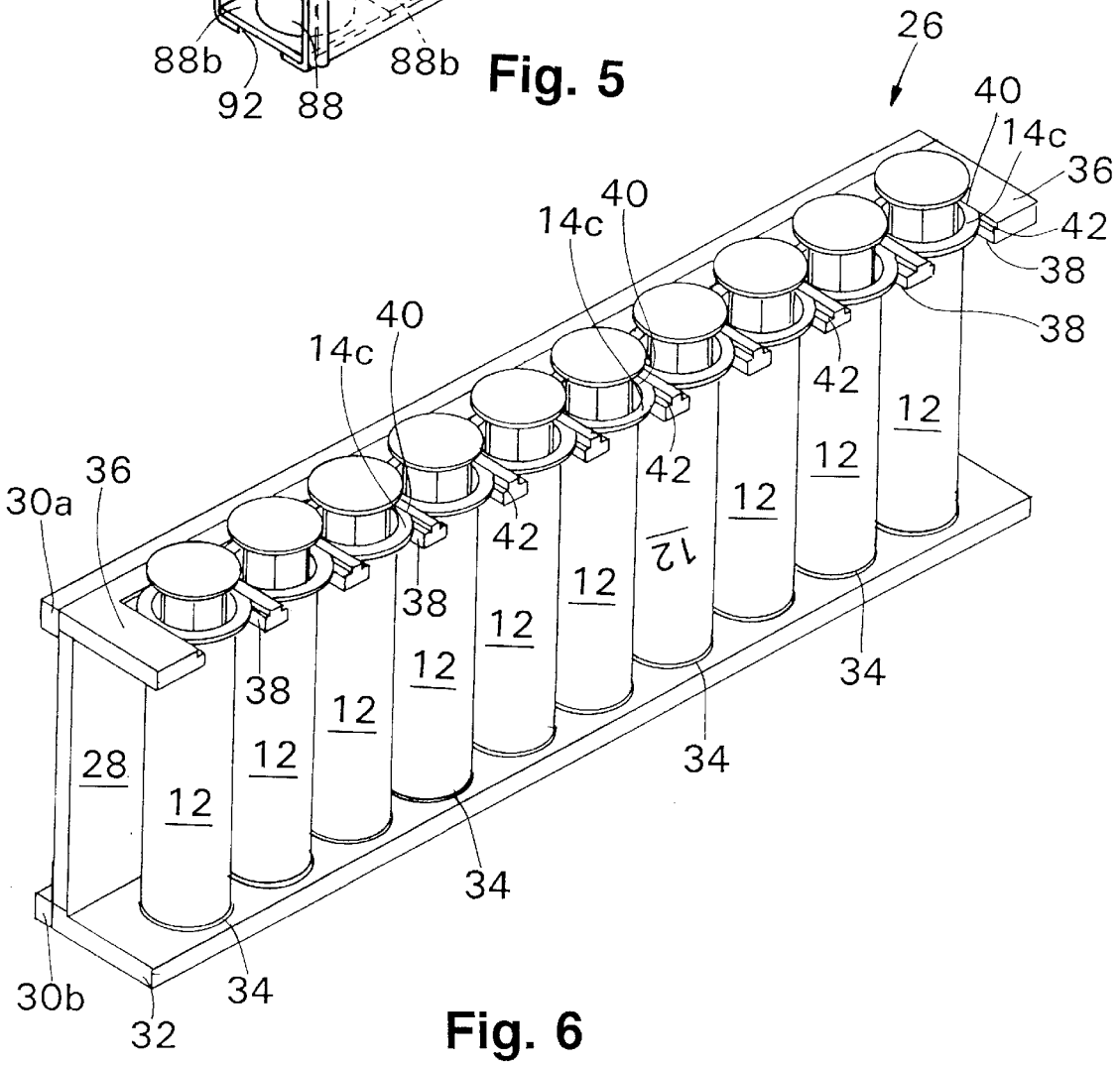
26
40
14c
36
42
38
38
42
12
12
12

METHOD AND APPARATUS FOR AUTOMATICALLY PRODUCING A PLURALITY OF STERILE LIQUID FILLED DELIVERY DEVICES

BACKGROUND OF THE INVENTION

The present invention relates to filling sterile delivery devices, such as syringes, and more particularly to a method and apparatus for automatically producing a plurality of prebilled, sterile delivery devices.

In the pharmaceutical industry, most hospitals have pharmaceutical compounding facilities. The pharmacists or technicians that work in the compounding facilities are often required to undertake manually intensive processes for filling plastic syringes with medicaments. Such medicaments are typically supplied to the pharmacists in one of two forms.

In the first form, the pharmacist receives 10 to 100 vials of dry, powdered medicament. Each vial includes a bottom having a periphery and a wall extending generally upwardly from the periphery. The container bottom and container wall define an interior container portion which receives the powdered medicament. The container wall extends upwardly to form a shoulder and a neck portion. The neck portion has an opening which receives a vial septum for sealing the opening and providing access to the interior container portion by piercing the vial septum with a needle, in a manner well understood by those of ordinary skill in the art.

It is the technician's responsibility to reconstitute the powdered medicament in the vial and transfer the reconstituted medicament to a sterile IV bag or bottle from which the reconstituted medicament can be dispensed, such as with a syringe or IV drip application. The technician places as many as 10 to 100 vials containing the powdered medicament into a laminar flow hood. A peristaltic pump with one set of transfer tubing and a container of sterile liquid, such as water, are placed under the laminar flow hood. The pump is used to transfer the sterile liquid from the container into the vials for the purpose of reconstituting the powdered medicament. The technician connects one end of the transfer tubing set between the pump and the container of sterile liquid. For instance, where the container of sterile fluid is an IV bag, the spike end of the transfer tubing is connected to the IV bag. The other end of the transfer tubing set extends between the pump and a Luer lock connector to which is attached a transfer needle.

To reconstitute the dry, powdered medicament within the vial, the technician pierces the vial septum of the vial with the transfer needle and then manually actuates the pump to begin transferring the sterile liquid from the sterile liquid container to the vial. When the pump is actuated, it automatically dispenses a preprogrammed amount of sterile liquid into the vial. Once the predetermined amount of sterile liquid is transferred to the vial, the pump automatically ceases operation. At this point, the technician removes the needle from the vial septum and inserts it into another vial septum of a vial having dry, powdered medicament therein and actuates the pump. The vial which has been filled with the predetermined amount of sterile liquid is then shaken to thoroughly mix the powdered medicament and the sterile liquid. This process is carried out for each of the 100 vials until they all have been reconstituted.

Once the powdered medicament in the vials has been reconstituted, it is then necessary to transfer the reconstituted powdered medicament to an IV bag or vacuum bottle for dispensing the reconstituted medicament to a syringe. First the pharmacy compounding technician must place the vials and an empty IV bag or vacuum bottle under the laminar hood for the transfer process. One end of transfer tubing is then connected between the pump and the empty IV bag or vacuum bottle by using the spike end of the transfer tubing to access the empty IV bag or vacuum bottle. The other end of transfer tubing is connected to the pump and at its distal end includes a Luer lock connector to which the technician attaches a transfer needle.

The technician then transfers the reconstituted powdered medicament within each vial to the sterile IV bag or vacuum bottle. This process is accomplished by having the technician hold an inverted vial in one hand while the other hand pierces the vial septum with the transfer needle. The technician then turns on the pump to extract the reconstituted powdered medicament from the vial. As the reconstituted powdered medicament is being transferred from the vial, the technician must be careful to draw all of the reconstituted powder medicament and therefore must locate the tip of the transfer needle just on the other side of the vial septum. Once the entirety of the reconstituted powder medicament is withdrawn from the vial, the technician must turn the pump off manually. This process is repeated for all 100 vials until all of the reconstituted powdered medicament has been transferred to one or more empty IV bags or vacuum bottles. The reconstituted powdered medicament is then transferred from the IV bags or bottles to sterile delivery devices as described below.

In the second form, the pharmacist receives 10 to 100 vials or containers of hydrated medicament which must be transferred to the sterile delivery devices. Thus, in the second form the step of reconstituting the dry, powdered medicament is avoided, but the hydrated medicament is then transferred to the sterile delivery devices using a two-step procedure. The use of the term "sterile delivery device" refers to any mechanical element used for delivering a sterile parenteral medicament. A typical sterile delivery device is a syringe. Syringes are provided in many different sizes, shapes and forms. Typically, the syringe includes a hollow barrel with a dispensing nozzle at one end and an open opposite end. A piston plunger is positioned within the open end and is slidable in sealing engagement with the barrel to retain a fluid therein. A hypodermic needle or other transfer device is secured to the dispensing nozzle in any of a number of ways, such as with a Luer lock.

The first step of the procedure is identical to that described above in connection with transferring the reconstituted powdered medicament within each vial to the sterile IV bag or vacuum bottle. The second step requires the technician to transfer the hydrated medicament in the large container (i.e. IV bag or vacuum bottle) to individual syringes which are then stored in an appropriate medium, such as a freezer, until it is time to administer the medicament. The technician can use a variety of methods to transfer the fluid from the container to the sterile delivery device. One method simply requires the pharmacist to place a tube between the container and the dispensing nozzle of the sterile delivery device, and then by pulling on the plunger the hydrated medicament is withdrawn from the container, through the tube and into the sterile delivery device.

Another method involves the use of a peristaltic pump and transfer device. In this method, the container of hydrated medicament is connected to the suction side of the pump using one end of the transfer tubing set. A transfer device is connected to the discharge side of the pump using the other end of the transfer tubing set. The transfer device may be in the form of a simple block having appropriate conduits such that the tubing leading from the discharge side of the pump feeds the hydrated medicament from the pump through the block to a female Luer lock connector. In use, the technician inverts a sterile delivery device with the male Luer lock dispensing nozzle receiving the female Luer lock connector from the transfer device in a sealed manner. The technician then actuates the pump which then transfers the fluid from the container to the sterile delivery device causing the plunger of the sterile delivery device to move upward until the pump automatically shuts off when a predetermined amount of the hydrated medicament has been transferred to the sterile delivery device. This process is repeated until the hydrated medicament is exhausted from the bag or until a desired number of sterile delivery devices have been filled.

As is apparent from the foregoing description, the process of filling the sterile delivery devices is labor intensive. This is even more apparent where the technician must hydrate one hundred vials of dry, powdered medicament and then transfer the hydrated medicament to sterile delivery devices.

Attempts have been made to improve upon the foregoing manual methods by providing prebilled sterile delivery devices. However, previous methods of filling sterile delivery devices involved filling the sterile delivery devices from the end of the sterile delivery device which receives the piston plunger. This method exposes the hydrated medicament to the atmosphere. Thus, risking the entry of microbial contaminants into the hydrated medicament. To minimize this risk, these previous methods of prefilling sterile delivery devices require that extensive steps be taken to ensure the transfer of the hydrated medicament in a sterile manner.

The present invention overcomes many of the disadvantages inherent in the above-described methods of prefilling sterile delivery devices by providing an apparatus which can automatically fill sterile delivery devices in a sterile manner without the necessity of requiring extensive steps be taken to prevent entrance of microbial contaminants into the hydrated medicament. The present invention fills the sterile delivery devices through the dispensing nozzle to minimize the risk of the hydrated medicament being exposed to atmosphere. Moreover, the present invention provides an automated method and apparatus for prefilling the sterile delivery devices which results in considerable savings in time and money as compared to the conventional methods of filling sterile delivery devices.

BRIEF SUMMARY OF THE INVENTION

Briefly stated, the present invention is directed to an apparatus for automatically producing a plurality of prefilled, sterile delivery devices. The sterile delivery devices each include a hollow barrel with a dispensing nozzle at one end and an open opposite end. A piston plunger is positioned within the open end and is in slidable sealing engagement with the barrel to retain a fluid therein. A tip is secured to the dispensing nozzle. The apparatus includes a predetermined feeding path configured to receive and move a plurality of the sterile delivery devices along the predetermined path. A tip removing station is positioned proximate to the path for removing the tips from the dispensing nozzles of the sterile delivery devices. The tip removing station engages and removes a tip from a sterile delivery device as the sterile delivery devices move along the predetermined feeding path. A fluid filling station is positioned proximate the path for filling the hollow barrels of the sterile delivery devices through the dispensing nozzles with a desired quantity of fluid. The fluid filling station includes a discharge end in fluid communication with a pump which dispenses the fluid. The discharge end is configured for complementary sealed engagement with the dispensing nozzles of the sterile delivery devices. The discharge end is movable between a first position wherein the discharge end is spaced from the sterile delivery devices and a second position wherein the discharge end is in complementary sealed engagement with a dispensing nozzle of a sterile dispensing device for passing fluid to the hollow barrel of the sterile dispensing device as the sterile delivery devices move along the path. A sealing station is positioned proximate the path for closing and sealing a dispensing nozzle of the sterilized delivery device having fluid located in the hollow barrel to provide sealed sterile delivery devices with sterile fluid contents. The sealing station includes a plurality of caps, each being complementarily sized to seal the dispensing nozzle of the sterile dispensing devices. The sealing station secures the caps in complementary sealed engagement with the dispensing nozzles of the sterile dispensing devices to seal the fluid within the hollow barrel of the sterile dispensing device as the sterile delivery devices move along the predetermined feeding path.

Another aspect of the present invention comprises a method of automatically producing the plurality of prefilled, sterile delivery devices. The method comprises the steps of automatically feeding a plurality of the sterile delivery devices along a predetermined path; removing the tips from the dispensing nozzles of the sterile delivery devices, filling the hollow barrels of the sterile delivery devices through the dispensing nozzles with a desired quantity of fluid; and closing and sealing the dispensing nozzles of the sterile delivery devices after the filling step to provide sealed sterile delivery devices with sterile fluid contents.

Another aspect of the present invention is a method of automatically mass producing filled, sterile delivery devices and distributing the filled sterile delivery devices to dispensing stations. The method comprises the steps of providing a parenteral medical material in powder form; mixing the medical material with a diluent to form a parenteral fluid; automatically feeding a plurality of the sterile delivery devices along a predetermined path; removing the tips from the dispensing nozzles of the sterile delivery devices; filling the hollow barrels of the sterile delivery devices through the dispensing nozzles with a desired quantity of the parenteral fluid; closing and sealing the dispensing nozzles of the sterile delivery devices after the filling step to provide sealed sterile delivery devices with sterile fluid contents; and shipping the sealed sterile delivery devices with sterile fluid contents to one or more dispensing stations.

Another aspect of the present invention is a method of automatically mass producing prefilled, sterile delivery devices and distributing the filled sterile delivery devices to dispensing stations. The method comprises the steps of providing about 0.5 kilograms of parenteral medical material in powder form; mixing the medical material with a diluent to form a parenteral fluid; filling the hollow barrels of the sterile delivery devices with a desired quantity of the parenteral fluid; closing and sealing the dispensing nozzles of the sterile delivery devices after the filling step to provide sealed sterile delivery devices with sterile fluid contents; and shipping the sealed sterile delivery devices with sterile fluid contents to one or more dispensing stations.

BRIEF DESCRIPTION OF THE DRAWINGS

The foregoing summary, as well as the following detailed description of presently preferred embodiment of the invention, will be better understood when read in conjunction with the appended drawings. For the purpose of illustrating the invention, there is shown in the drawings an embodiment which is presently preferred. It should be understood, however, that the present invention is not limited to the particular arrangement and instrumentality shown. In the drawings:

FIG. 5 is a greatly enlarged perspective view of a magazine for holding a plurality of caps to be applied to the sterile delivery devices;

FIG. 6 is a perspective view of a magazine holding a plurality of empty sterile delivery devices.

DETAILED DESCRIPTION OF THE INVENTION

Figure 1:
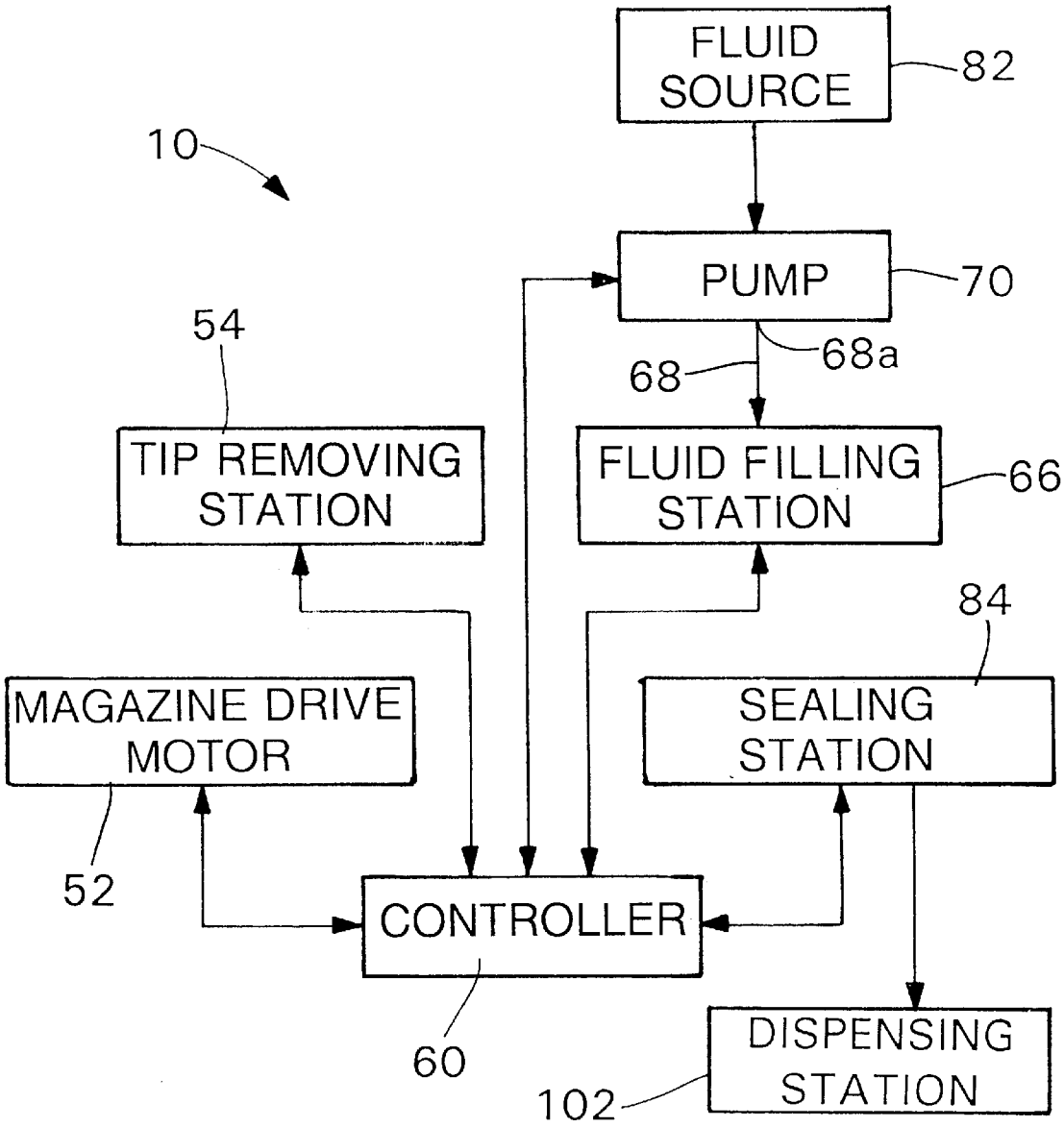
FIG. 1 is a block diagram schematic view of an apparatus for automatically producing a plurality of prebilled, sterile delivery devices in accordance with the present invention.

Certain terminology is used in the following description for convenience only and is not limiting. The words, "right," "left," "lower," and "upper," designate directions in the drawings to which reference is made. The words "inwardly" and "outwardly" refer to directions toward and away from, respectively, the geometric center of the apparatus for automatically producing a plurality of prebilled, sterile delivery devices and designated parts thereof. The terminology includes the words above specifically mentioned, derivatives thereof and words of similar import.

Referring to the drawings in detail, wherein like numerals indicate like elements throughout, there is shown in FIGS. 1 through 7G a preferred embodiment of an apparatus for automatically producing a plurality of prefilled, sterile delivery devices (hereinafter referred to as "sterile delivery device filling machine"), generally designated 10. Referring now to FIGS. 3A through 4D and FIGS. 6–7G, the sterile delivery device filling machine 10 is shown having sterile delivery devices 12 mounted thereon in various stages of use. Sterile delivery devices are well known to those of ordinary skill in the art and come in various sizes, shapes and forms.

In the present embodiment, the sterile delivery device 12 is a syringe constructed of a suitable sterilizable material, such as plastic or glass. Each sterile delivery device 12 includes a hollow barrel 14, with a dispensing nozzle 16 at one end 14*a* and an open opposite end 14*b* having a finger flange 14*c* extending radially therefrom. A piston plunger 18 is positioned within the open end 14*b* and is in slidable sealing engagement with the hollow barrel 14 to retain a fluid 20 therein in a manner well understood by those of ordinary skill in the art. A tip 22 is secured to the dispensing nozzle 16. The tip 22 can be secured to the dispensing nozzle 16 in any of a number of manners, such as a friction connection or using a Luer lock connection. In the event that a Luer lock connection is used, the tip 22 is secured to the dispensing nozzle 16, using a twist on connection, as is well understood by those of ordinary skill in the art.

As will be apparent from the following description, the present invention is not limited to any particular type of sterile delivery device 12. That is, other sterile delivery devices can be used to practice the invention, such as IV bags and disposable infusion bottles without departing from the spirit and scope of the invention.

Referring now to FIGS. 7A through 7G, the sterile delivery device filling machine 10 includes a frame 24. The frame 24 supports the various elements of the sterile delivery device filling machine 10, as described in more detail hereinafter. In the present embodiment, it is preferred that the frame 24 be constructed of a high strength material, such as stainless steel. The frame 24 is shown schematically in the figures since the present invention is not limited to any particular type of frame 24 for mounting the various elements of the sterile delivery device filling machine 10. That is, the frame 24 is constructed in a manner to position and support the various elements of the sterile delivery device filling machine 10 to carry out the function of the present invention, as described in more detail hereinafter. Accordingly, a detailed description of the frame 24 is omitted for purposes of brevity and convenience only and is not limiting.

Referring now to FIG. 6, there is shown a feeding magazine 26 for holding a plurality of sterile delivery devices 12 in an inverted position. That is, the sterile delivery devices 12 are positioned on the feeding magazine 26 such that the dispensing nozzles 16 are pointed downwardly to allow fluid 20 within the hollow barrel 14 to flow toward the dispensing nozzle 16 due to the force of gravity. The feeding magazine 26 includes a generally rectangular support wall 28. The support wall 28 extends the length of the feeding magazine 26 and includes two upper and lower rail members 30*a*, 30*b*, positioned on the back surface of the support wall 28, extending generally perpendicularly therefrom. The rail members 30*a*, 30*b* are spaced from each other a distance which corresponds to the height of the support wall 28. The purpose of the rail members 30*a*, 30*b* is described hereinafter.

A guide flange 32 extends generally perpendicularly from the support wall 28 at a position opposite from the lower rail 30*b*. The guide flange 32 includes a plurality of generally circular apertures 34 which are sized to complementarily receive the one end 14*a* of the hollow barrel 14 of the sterile delivery devices 12. The apertures 34 assist in maintaining the sterile delivery devices 12 on the feeding magazine 26. A support flange 36 extends generally perpendicularly from the support wall 28 at a position opposite from the upper rail 30*a*. The support flange 36 includes a plurality of notches 38 which are sized to complementarily receive the finger flange 14*c* extending outwardly from the open end 14*b* of the hollow barrel 14. The notches 38 include grooves 42 for receiving the linear portions 40 of the finger flanges 14*c* to prevent the sterile delivery devices 12 from rotating with respect to the feeding magazine 26.

In the present embodiment it is preferred that the feeding magazine 26 hold ten sterile delivery devices 12. However, it is understood by those of ordinary skill in the art from this disclosure that the present invention is not limited to mounting any particular number of sterile delivery devices 12 on the feeding magazine 26. For instance, two, eight, twelve or twenty or more sterile delivery devices 12 could be mounted on the feeding magazine 26. Moreover, the present invention is not limited to the use of a feeding magazine 26. That is, the sterile delivery devices 12 can be carried, transported and supported on the sterile delivery device filling machine 10 in any number of manners, such as by an index conveyor system (not shown).

In the present embodiment, it is preferred that the feeding magazine 26 be constructed of a high-strength, lightweight material, such as a polymeric material. Portions of the feeding magazine could be constructed of other high-strength, lightweight materials without departing from the spirit and scope of the invention. For instance, the upper and lower rails 38*a,* 38*b* could be constructed of a metallic material, such as aluminum.

It is also understood by those of ordinary skill in the art from this disclosure that the present invention is not limited to any particular manner of securing the sterile delivery devices 12 to the feeding magazine 26. For instance, the sterile delivery devices 12 could be secured to support wall 28 using a clamping mechanism (not shown) which would secure the sterile delivery devices 12 to the support wall 28.

Referring now to FIGS. 7A through 7G, the feeding magazine 26 is disposed on the frame 24 and movable along a predetermined path, represented by the arrow 44, with respect thereto. More particularly, the feeding magazine 26 is mounted to a drive carriage 46. The drive carriage 46 is mounted to the frame 24 in a manner which is not shown in the drawings. The drive carriage 46 includes a housing 48 having two generally parallel longitudinal slots 50 extending substantially the length of the drive carriage 46. Mounting hardware (not shown) extends from the slots 50 and engages the upper and lower rails 30*a,* 30*b* of the feeding magazine 26, to thereby support the feeding magazine 26 on the drive carriage 46. The mounting hardware also includes a plurality of clips (not shown) which extend over the finger flanges 14*c* of the sterile delivery devices 12 to vertically lock the sterile delivery devices 12 to the feeding magazine 26. The mounting hardware is driven by a magazine drive motor 52, shown schematically in FIG. 1, to move the feeding magazine 26 along the path 44 for the length of the drive carriage 46. The control of the movement of the feeding magazine 26 with the magazine drive motor 52 is described in more detail hereinafter.

In the present embodiment, it is preferred that the drive carriage 46 be comprised of a Commercial Economy EC6 Series, Ball Rail available from Design Components, Inc., Franklin, Mass. More particularly, it is preferred that an EC6-240 Ball Rail from Design Components be used having a travel length of 24 inches and a speed of 10 inches per second. While in the present embodiment it is preferred that an EC6-240 Ball Rail be used, it is understood by those of ordinary skill in the art from this disclosure that the present invention is not limited to any particular type of drive mechanism for moving the feeding magazine 26 along the predetermined path 44. That is, other devices which can be controlled in the manner described hereinafter can be used for moving the feeding magazine 26 along the predetermined path 44, such devices include a lead and precision roll ball screw and belt drive with ball railing.

While the foregoing description of the feeding magazine 26 and drive carriage 46 represents one mode of moving the sterile delivery devices 12 along the predetermined path 44, it is understood by those of ordinary skill in the art from this disclosure that the present invention is not limited to any particular method of conveying the sterile delivery devices along the path 44 so long as the path 44 is configured to receive and move a plurality of the sterile delivery devices 12 along the path 44.

Referring now to FIGS. 2A–2D, there is shown a tip removing station 54 mounted on the frame 24 proximate the path 44 for removing the tips 22 from the dispensing nozzles 16 of the sterile delivery devices 12. FIGS. 2A through 2D show the sequential operation of the tip removing station 54. The tip removing station 54 includes a movable gripping arm 56 which engages and removes a tip 22 from a sterile delivery device 12 on the feeding magazine 26 as the feeding magazine 26 moves along the path 44. More particularly, the gripping arm 56 grasps and rotates each tip 22 to remove the tips 22 from the dispensing nozzles 16 of the sterile delivery devices 12.

Figure 2A:
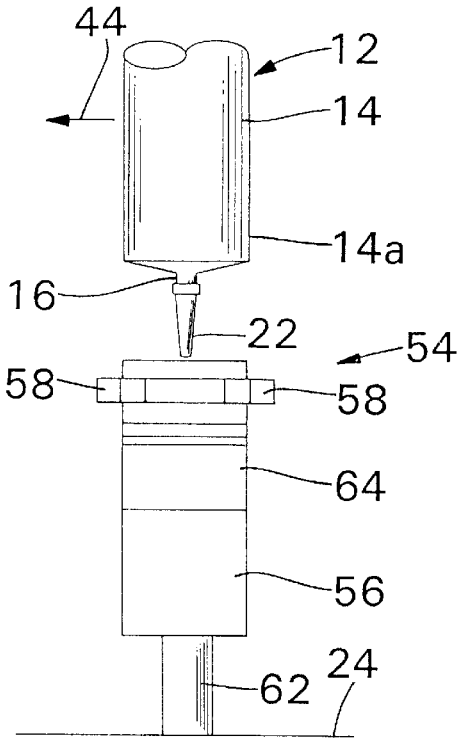
FIGS. 2A through 2D are enlarged front elevational views of the sequential operation of a tip removing station of the apparatus of FIG. 1.
Figure 2B:
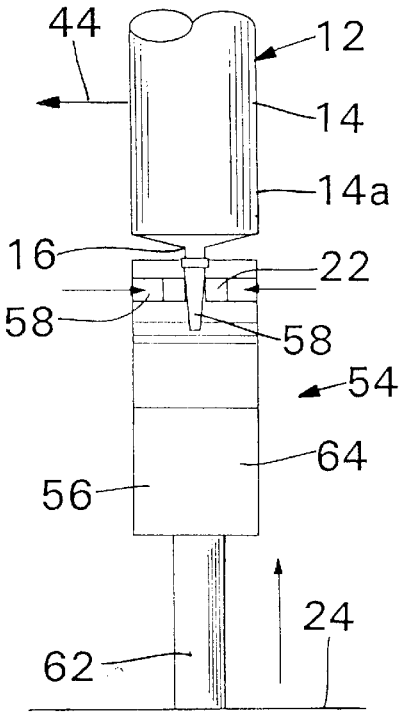
Figure 2C:
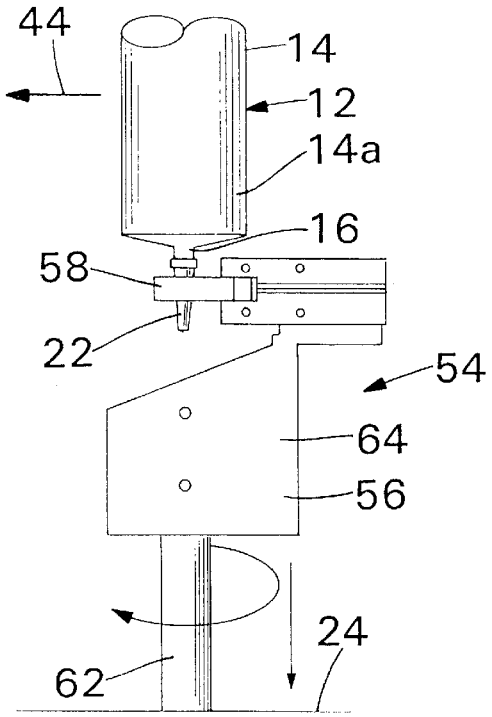
Figure 2D:
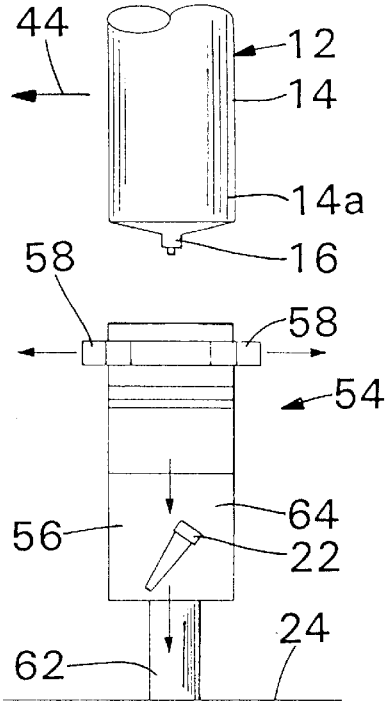

FIG. 2A shows a sterile delivery device 12 initially positioned over the gripping arm 56. Once the sterile delivery device 12 is initially positioned over the gripping arm 56, the gripping arm 54 raises upwardly from the frame 24 until the tip 22 is located between a pair of pivotally mounted linear grasping elements 58, as shown in FIG. 2B. The grasping elements 58 are initially positioned apart from each other to allow space for the tip 22 to be inserted therebetween, as shown in FIG. 2A. Once the gripping arm 56 has been raised to the position where the tip 22 is located between the spaced apart grasping elements 58, the grasping elements 58 are moved towards each other to grasp the tip 22, as shown in FIG. 2B. After the tip 22 has been grasped by the grasping elements 58, the gripping arm 56 moves downwardly and simultaneously rotates counterclockwise, as viewed from looking up at the sterile delivery device 12 (see FIG. 2C). As a result, the grasping elements 58 remove the tip 22 from the dispensing nozzle 16. Once the gripping arm 56 travels to its original position, the grasping elements 58 are moved away from each other and the tip 22 is released. A chute (not shown) is provided for guiding the tip 22 to a storage, recycle or disposal bin (not shown).

While in the present embodiment it is preferred that the gripping arm 56 rotate counterclockwise as it moves downwardly (see FIG. 2C), it is understood by those of ordinary skill in the art from this disclosure that the present invention is not limited to rotating the gripping arm 56. For instance the tips 22 may be merely frictionally secured to the dispensing nozzles 16 and a simple downward movement would then remove the tips 22 from the dispensing nozzles 16. Moreover, where the sterile delivery devices 12 are pre-supplied without tips 22 then the tip removing station 54 could be omitted in its entirety without departing from the spirit and scope of the invention.

Referring now to FIGS. 1 and 2A–2D, the movement of the gripping arm 56 and the grasping elements 58 are controlled by solenoid operated pneumatic cylinders (not shown). The solenoids (not shown) which control the operation of the pneumatic cylinders are controlled by a micro stepping controller 60 which monitors and controls the position of the feeding magazine 26 and the tip removing station 54. In the present embodiment, it is preferred that the micro stepping controller be Model No. DI400P available from Design Components, Inc. in Franklin, Mass. The micro stepping controller 60 is programmable to permit the precise synchronous operation of the magazine drive motor 52 and the tip removing station 54 by controlling the solenoids (not shown) in a manner well understood by those of ordinary skill in the art. Accordingly, further description thereof is omitted for purposes of brevity and is not limiting.

While in the present embodiment it is preferred that the DI400P micro stepping controller 60 be used, it is understood by those of ordinary skill in the art from this disclosure that the present invention is not limited to any particular mechanism for controlling the operation of the sterile delivery device filling machine 10. For instance, the operation and sequencing of the sterile delivery device filling machine 10 could be controlled by any suitable microprocessor based control system.

The gripping arm 56 includes a cylindrical rod 62 which reciprocates with respect to the frame 24 and is directly connected to the pneumatic cylinders which control the gripping arm 56. A grasping element control housing 64 is mounted to the distal end of the rod 62. The grasping elements 58 are pivotally mounted to the control housing 64 in a manner well understood by those of ordinary skill in the art.

Referring now to FIGS. 3A through 3C and 7D through 7G, the sterile delivery device filling machine 10 includes a fluid filling station 66 mounted on the frame 24 proximate the path 44 for filling the hollow barrels 14 of the sterile delivery devices 12 through the dispensing nozzle 16 with a desired quantity of fluid. More particularly, as shown in FIGS. 1 and 3A through 3C, the fluid filling station 66 includes a filling tube 68 (represented schematically in FIG. 1) having a first end 68*a* in fluid communication with a pump 70 (represented schematically in FIG. 1) which dispenses the fluid 20 such that fluid 20 dispensed by the pump 70 flows into the filling tube 68. The filling tube 68 includes a second or discharge end 68*b* configured for complementary sealed engagement with the dispensing nozzles 16 of the sterile delivery devices 12.

Figures 3A, 3B, 3C:
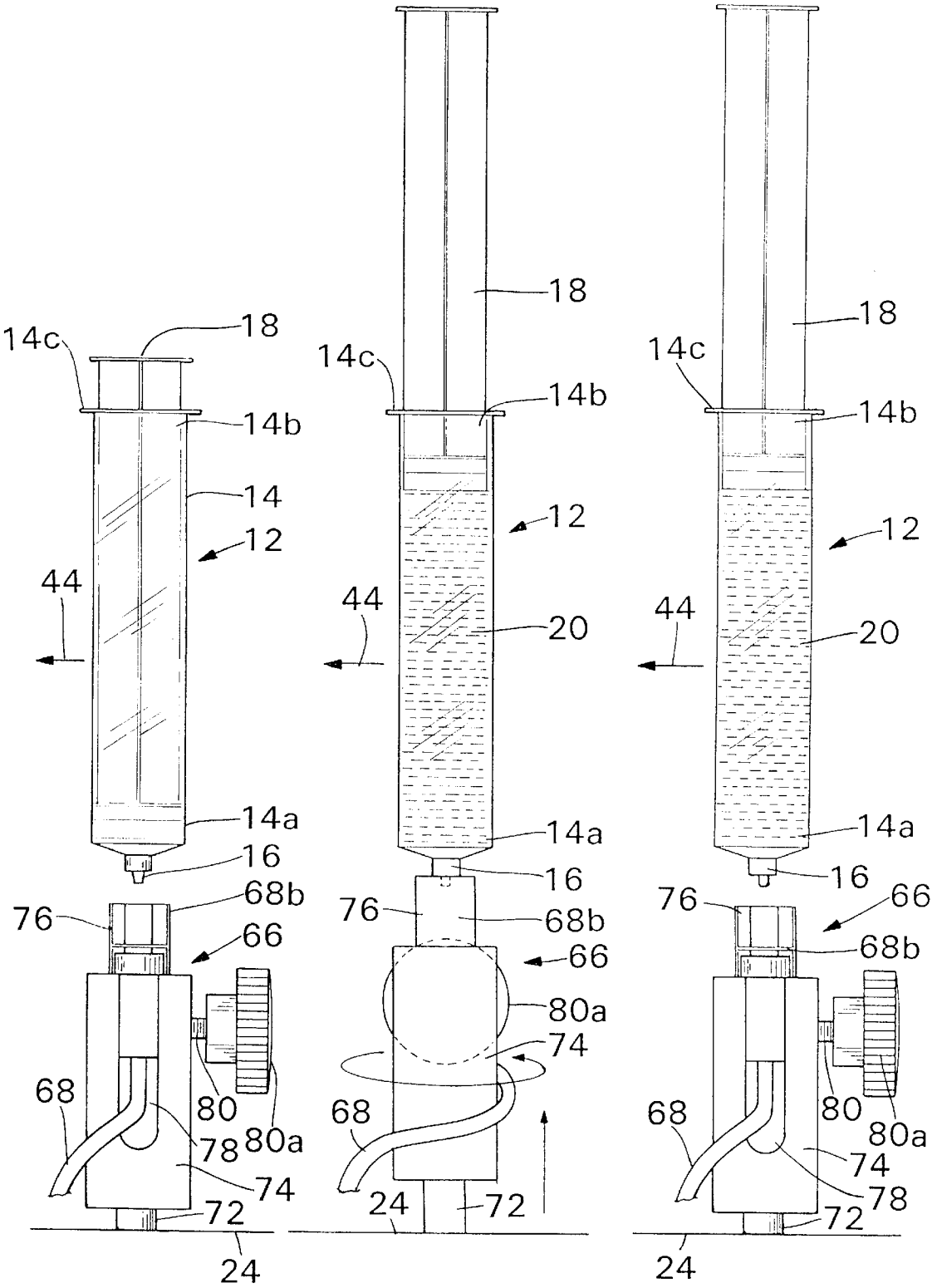
FIGS. 3A through 3C are enlarged front elevational views of the sequential operation of a fluid filling station of the apparatus of FIG. 1.

As shown in FIGS. 3A through 3C, the filling tube 68 is movable between a first position (shown in FIGS. 3A, 3C and 7A–7C) when the second end 68*b* is spaced from the sterile delivery devices 12 and a second position (shown in FIGS. 3B and 7D–7G) when the second end 68*b* is in complementary sealed engagement with a dispensing nozzle 16 of a sterile delivery device 12 for passing fluid 20 to the hollow barrel 14 of the sterile delivery device 12 as the feeding magazine 26 moves along the path 44.

As shown in FIG. 3A, the fluid filling station 66 includes a reciprocating rod 72 which includes a filling tube housing 74 mounted thereon. The filling tube housing 74 includes a female Luer lock connector 76 positioned within an aperture in the terminal end of the filling tube housing 74. The filling tube housing 74 includes a slot 78 through which the filling tube 76 passes. The female Luer lock connector 76 is secured within the aperture in the terminal end of the filling tube housing 74 via a screw 80 having a knob 80*a* thereon which is rotated to act as a set screw. That is, by rotating the knob 80*a* the female Luer lock connector 76 can be secured within the filling tube housing 74 or removed for replacement.

In the present embodiment, it is preferred that the pump 70 be a programmable pump which can rapidly and accurately pump a precise quantity of fluid, such as a peristaltic pump. One example of a peristaltic pump which would meet the needs of the present invention is the Baxa Repeater Pump sold by the Baxa Corporation in Englewood, Colo. The pump 70 is programmable in a manner to achieve the functions described hereinafter. While it is preferred that the pump 70 of the present invention be a Baxa Repeater Pump, it is well understood by those of ordinary skill in the art that the present invention is not limited to any particular type of pump, and that other pumps may be used to carry out the functions of the present invention without departing from the spirit and scope of the invention.

As shown in FIG. 1, the pump 70 is in fluid communication with a fluid source 82. The position of the fluid filling station 66 and the operation of the pump 70 are controlled by the controller 60. That is, when an empty sterile delivery device 12 is positioned over the fluid filling station 66, as shown in FIG. 3A, a signal is sent by the controller 60 to raise the fluid filling station 66 upwardly into the second position to engage the female Luer lock connector 76 with the dispensing nozzle 16. Once the female Luer lock connector 76 and the dispensing nozzle 16 are in engagement, the rod 72 and filling tube housing 74 are rotated clockwise to tighten the female Luer lock connector 76 onto the dispensing nozzle 16. The pump 70 is then automatically actuated to pump fluid from the fluid source 82, through the pump 70, through the filling tube 68 into the hollow barrel 14 of the sterile delivery device 12 such that, as fluid 20 flows into the hollow barrel 14, the hollow barrel 14 fills from the dispensing nozzle 16 to the open end 14*b* of the hollow barrel, and thereby forces the piston plunger 18 upwardly. Once the pump 70 has completed filling the sterile delivery device 12 with fluid 20, the rod 72 and filling tube housing 74 are rotated counterclockwise and moved downwardly to the position shown in FIG. 3C.

The movement of the rod 72 and filling tube housing 74 is controlled by pneumatic cylinders (not shown) which are operated by the controller 60 in a manner similar to that described above in connection with the tip removing station 54. Accordingly, further description thereof is omitted for purposes of convenience only, and is not limiting.

Referring now to FIGS. 4A through 4D, there is shown a sealing station 84 mounted on the frame 24 proximate the path 44 for closing and sealing a dispensing nozzle 16 of the sterile delivery device 12 having fluid 20 located in the hollow barrel 14 to provide sealed sterile delivery devices 12 with sterile fluid contents. The sealing station 84 includes a movable pickup rod 86 having a terminal end 86*b* with a cap 88 thereon. The cap 88 is complementarily sized to seal the dispensing nozzle 16 of the sterile dispensing device 12. The pickup rod 86 is movable between a first position (shown in FIGS. 4A, 4C and 4D) wherein the terminal end 86*b* is spaced from the sterile delivery devices 12 in the feeding magazine 26 and a second position (shown in FIG. 4B) wherein the terminal end 86*b* positions the cap 88 in complementary sealed engagement with a dispensing nozzle 16 of a sterile delivery device 12 to seal the fluid 20 within the hollow barrel 14 of the sterile delivery device 12 as the feeding magazine 26 moves along the path 44. More particularly, the pickup rod 86 rotatably secures the cap 88 to the dispensing nozzle 16 of each sterile delivery device 12 by rotating the cap 88 onto the dispensing nozzle 16, using a standard Luer lock connection.

Referring now to FIG. 5, in the present embodiment, it is preferred that a plurality of caps 88 be supplied in a magazine clip 90 which corresponds to the number of sterile delivery devices 12 in the feeding magazine 26. As such, a magazine clip 90 and feeding magazine 26 are loaded onto the sterile delivery device filling machine 10 for each cycle of the sterile delivery device filling machine 10, as described in more detail hereinafter. However, it is understood by those of ordinary skill in the art from this disclosure that the present invention is not limited to having corresponding numbers of caps 88 and sterile delivery devices 12 in the magazines 26, 90.

Each cap 88 includes an open end 88*a* which is configured for complementary sealed engagement with the dispensing nozzle 16 in a standard Luer lock fashion. The opposite end of the cap 88 includes a generally rectangular flange 88*b* which is used to assist in rotating the cap 88 onto the dispensing nozzle 16.

While in the present embodiment it is preferred that the cap 88 be of the Luer lock connection type, it is understood by those of ordinary skill in the art from this disclosure that the present invention is not limited to any particular type of cap 88. That is, the cap 88 could merely be a snap fit onto the dispensing nozzle 16, fit by friction, or be clamped onto the dispensing nozzle 16 without departing from the spirit and scope of the invention.

As shown in FIG. 5, the magazine clip 90 is hollow for receiving a plurality of the caps 88 and is generally rectangular in cross section. A longitudinal slot 92 is provided on the underside of the magazine clip 90 for allowing a push rod 94 to enter into the magazine clip 90 from underneath the magazine clip 90 and push the caps 88 through or along the magazine clip 90, as described in more detail hereinafter.

Figure 4A:
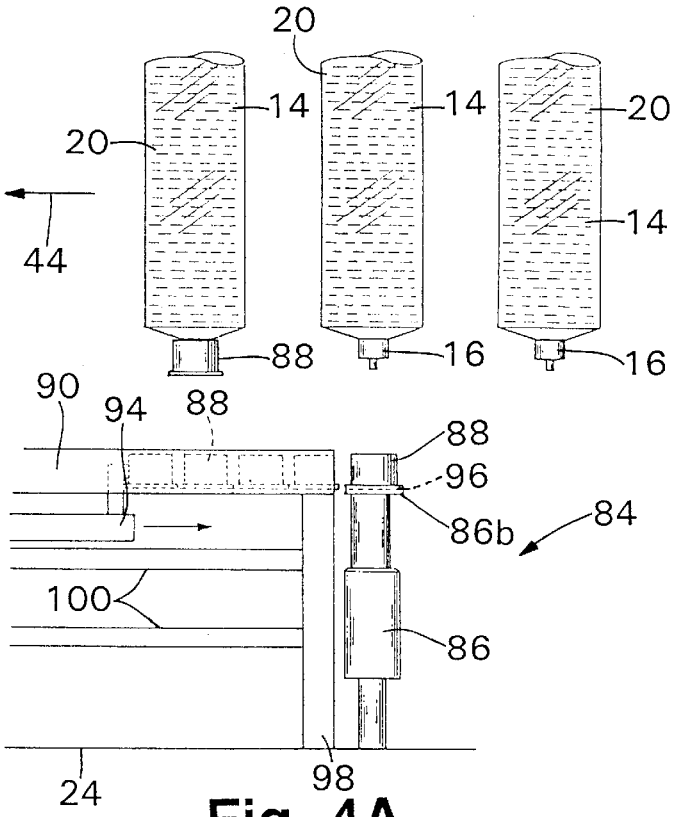
FIGS. 4A through 4D are enlarged front elevational views of the sequential operation of a sealing station of the apparatus of FIG. 1.
Figure 4B:
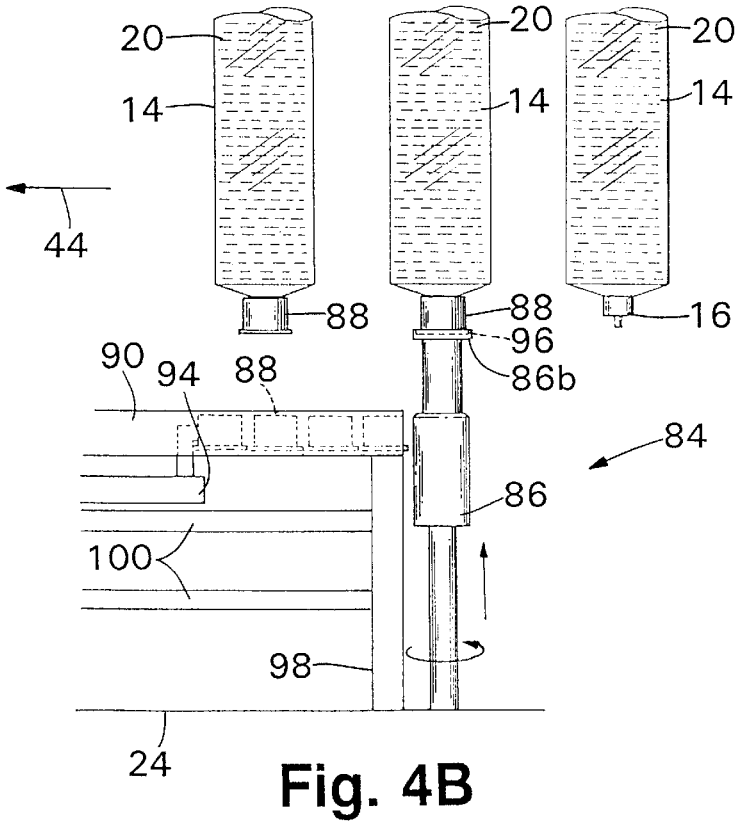
Figure 4C:
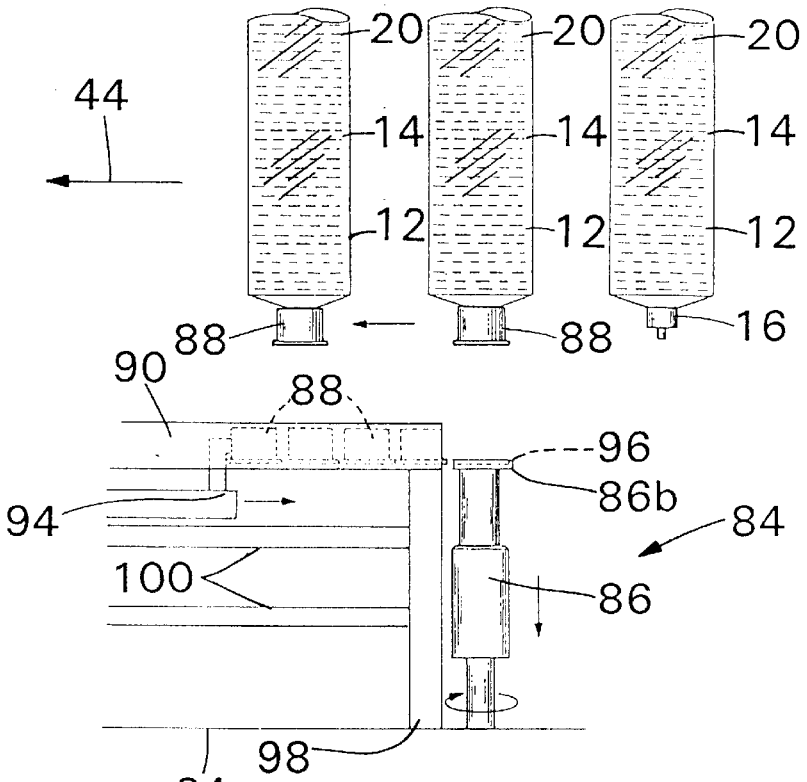

Referring now to FIG. 4A, there is shown the pickup rod 86 having a cap 88 located on its terminal end 86*b*. The terminal end 86*b* of the pickup rod 86 includes a generally rectangular depression 96 on the top surface thereof for complementarily receiving the rectangular flange 88*b* of the cap 88. With a cap 88 located in the depression 96 of the pickup rod 86 and a sterile delivery device 12 which has been filled with fluid 20 positioned over the pickup rod 86, the pickup rod 86 is moved upwardly to engage the cap 88 with the dispensing nozzle 16. Once the cap 88 and dispensing nozzle 16 are engaged, the pickup rod 86 rotates to rotatably secure the cap 88 to the dispensing nozzle 16, as shown in FIG. 4B. After the cap 88 is secured to the dispensing nozzle 16, the pickup rod 86 moves downwardly and rotates to return to the first position, as shown if FIG. 4C. Simultaneously, the feeding magazine 26 is indexed to the left along the path 44 to position the next sterile delivery device 12 over the pickup rod 86.

Positioned adjacent to the pickup rod 86 is a mechanism for feeding caps 88 onto the terminal end 86*b* of the pickup rod 86. The mechanism comprises a housing 98. The magazine clip 90 filled with caps 88 is positioned on top of the housing 98 and the push rod 94 extends above the housing 98 through the longitudinal slot 92 in the magazine clip 90 to engage the leftmost cap 88 in the magazine clip 90. The push rod 94 is mounted for reciprocal movement on a pair of guide rails 100. The specific manner in which the push rod 94 is mounted on the guide rails 100 is not pertinent to the invention, and therefore, is not shown.

The push rod 94 can be controlled by any standard indexing mechanism which will move the push rod 94 a distance the width of one cap 88 as each sterile delivery device 12 is indexed across the path 44. In the present embodiment it is preferred that the push rod 94 be actuated by a subfractional AC brake type gear motor which includes a rotary motion to linear motion transfer device (not shown), such as a Dayton 50 RPM Model 3M258. However, it is understood by those of ordinary skill in the art that the present invention is not limited to any particular method of controlling the push rod 94.

Figure 4D:
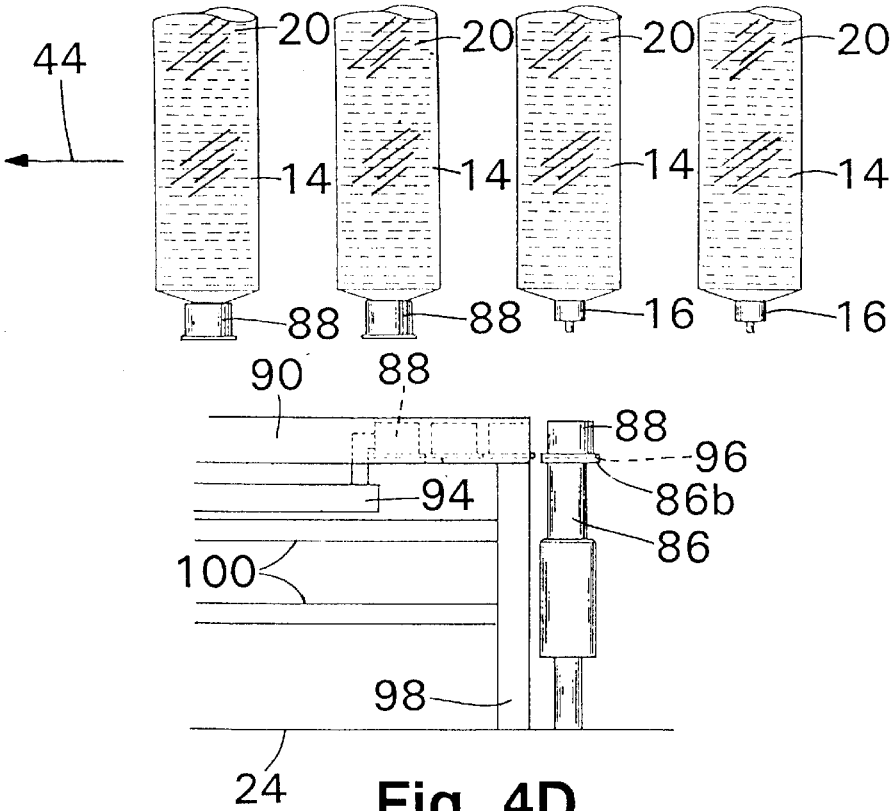

As shown in FIG. 4D, after a cap 88 is applied to a dispensing nozzle 16 of a sterile delivery device 12, the feeding magazine 26 is indexed a distance of one sterile delivery device 12 along the path 44 while the push rod 94 moves to the right to push a cap 88 through the terminal end of the magazine clip 90 onto the depression 96 in the terminal end 86*b* of the pickup rod 86 after the pickup rod 86 has returned to the first position. The process of then applying a cap 88 to the dispensing nozzle 16 is then repeated for the next sterile delivery device 12.

The movement of the pickup rod 86 is controlled by pneumatic cylinders (not shown) which are operated by the controller 60 in a manner similar to that described above in connection with the tip removing station 54. Accordingly, further description thereof is omitted for purposes of convenience only, and is not limiting.

Referring now to FIG. 1, the magazine drive motor 52 is operatively associated with the feeding magazine 26 for moving the feeding magazine 26 along the path 44 with respect to the tip removing station 54, fluid filling station 66 and sealing station 84 in an indexed manner to pass each sterile delivery device 12 in the feeding magazine 26 through the tip removing station 54, fluid filling station 66 and sealing station 84 such that sealed sterile delivery devices 12 with sterile fluid contents 20 are located within the feeding magazine 26 after the feeding magazine 26 moves along the path 44 past the tip removing station 54, fluid filling station 66 and sealing station 84.

Figure 7A:
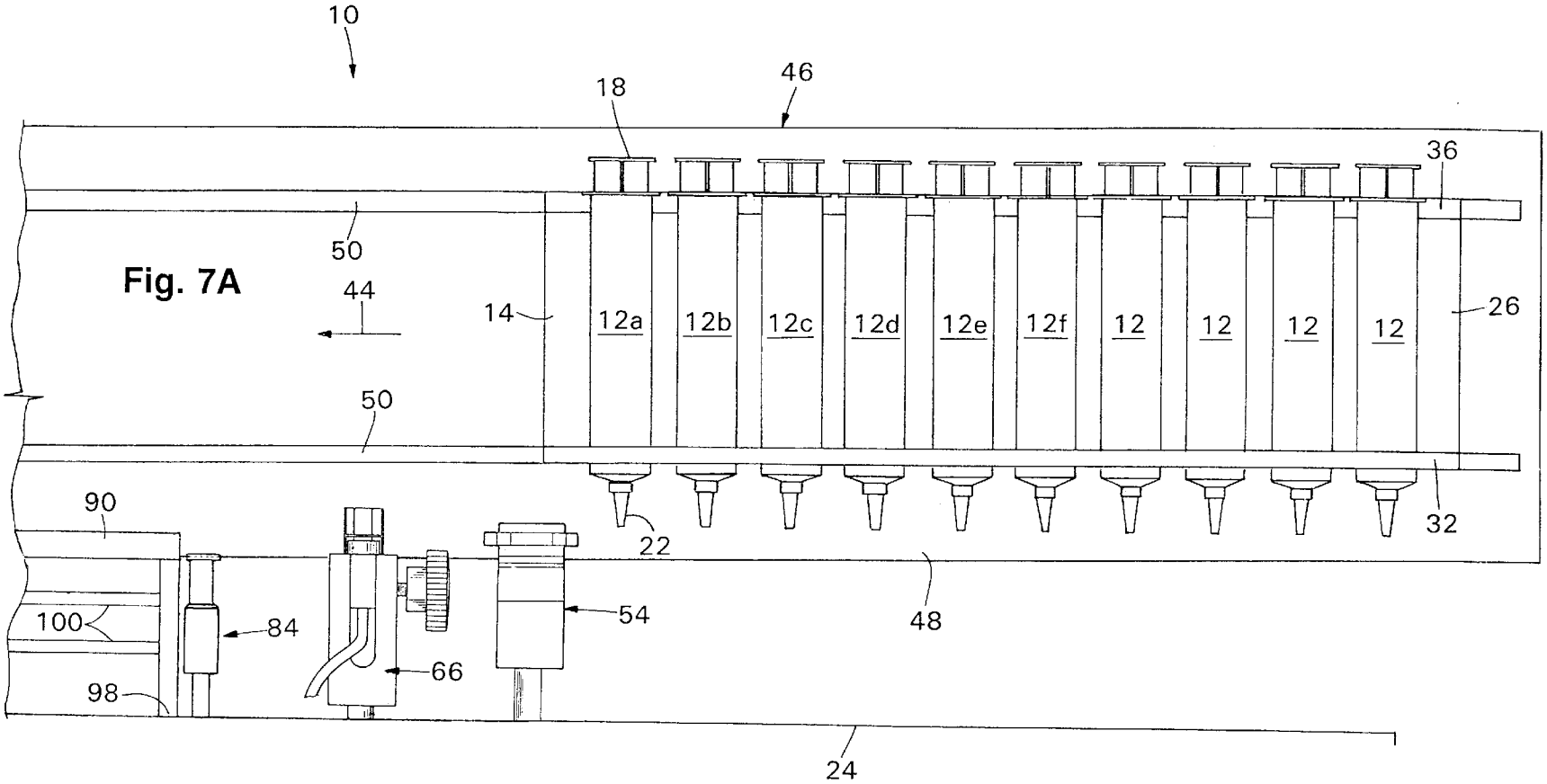
FIGS. 7A through 7G are schematic front elevational views showing the sequential operation of the apparatus of FIG. 1.

In use, an empty feeding magazine (not shown) is loaded with a selected number, such as ten, of empty sterile delivery devices 12 with the piston plunger 18 in the down position. Once the feeding magazine 26 is loaded with the sterile delivery devices 12, it is mounted to the drive carriage 46 with the first sterile delivery device 12 adjacent the tip removing station 54, as shown in FIG. 7A. Similarly, a magazine clip 90 is mounted on the housing 98 with a number of caps 88 therein, which corresponds to the number of sterile delivery devices 12 in the feeding magazine 26. Before proceeding with filling the sterile delivery devices 12, the fluid source or bag 82 is checked to confirm that there is sufficient content of fluid medicament therein to fill all of the sterile delivery devices 12 on the feeding magazine 26. The sterile delivery device filling machine 10 is then set for operation.

Figure 7B:
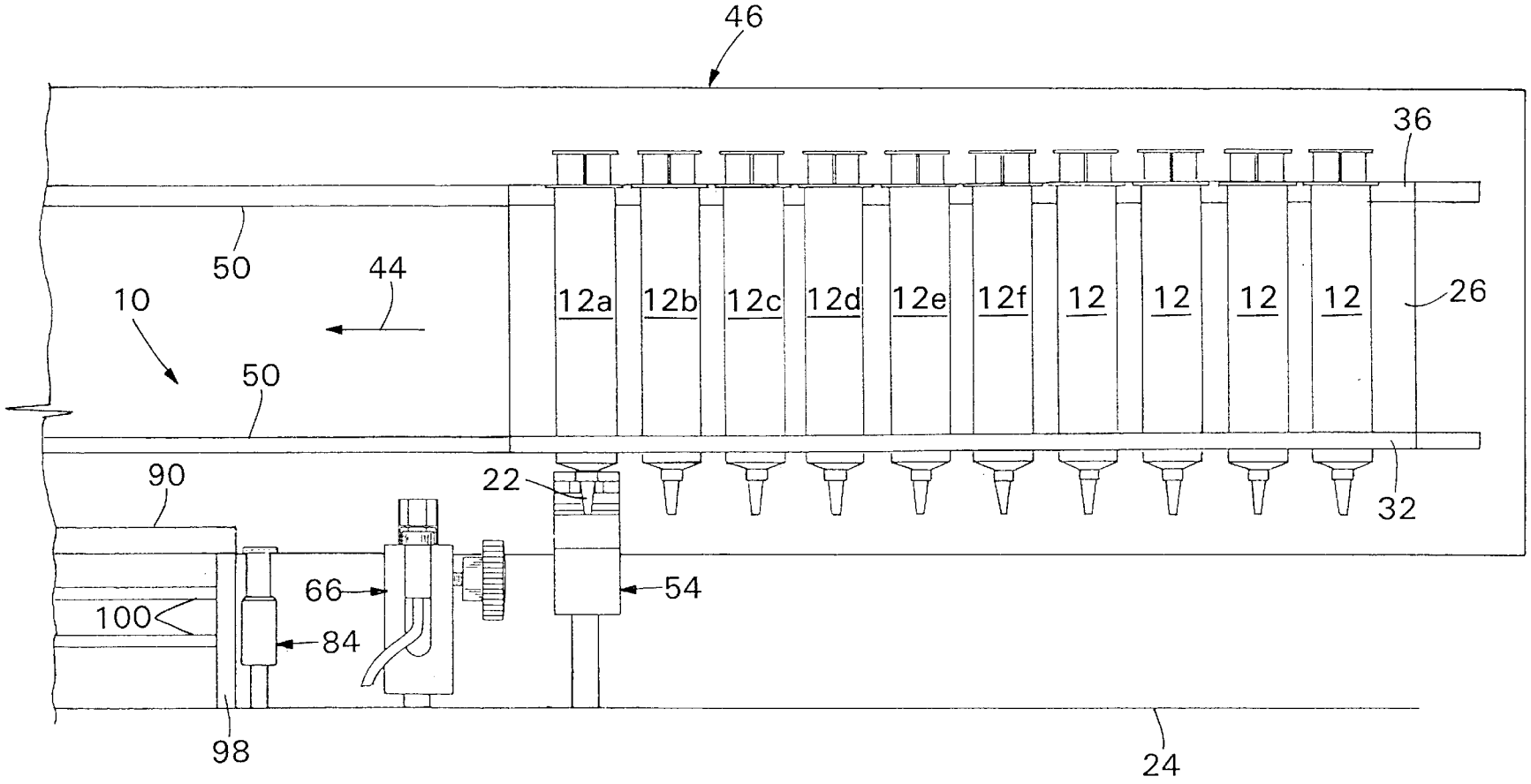
Figure 7C:
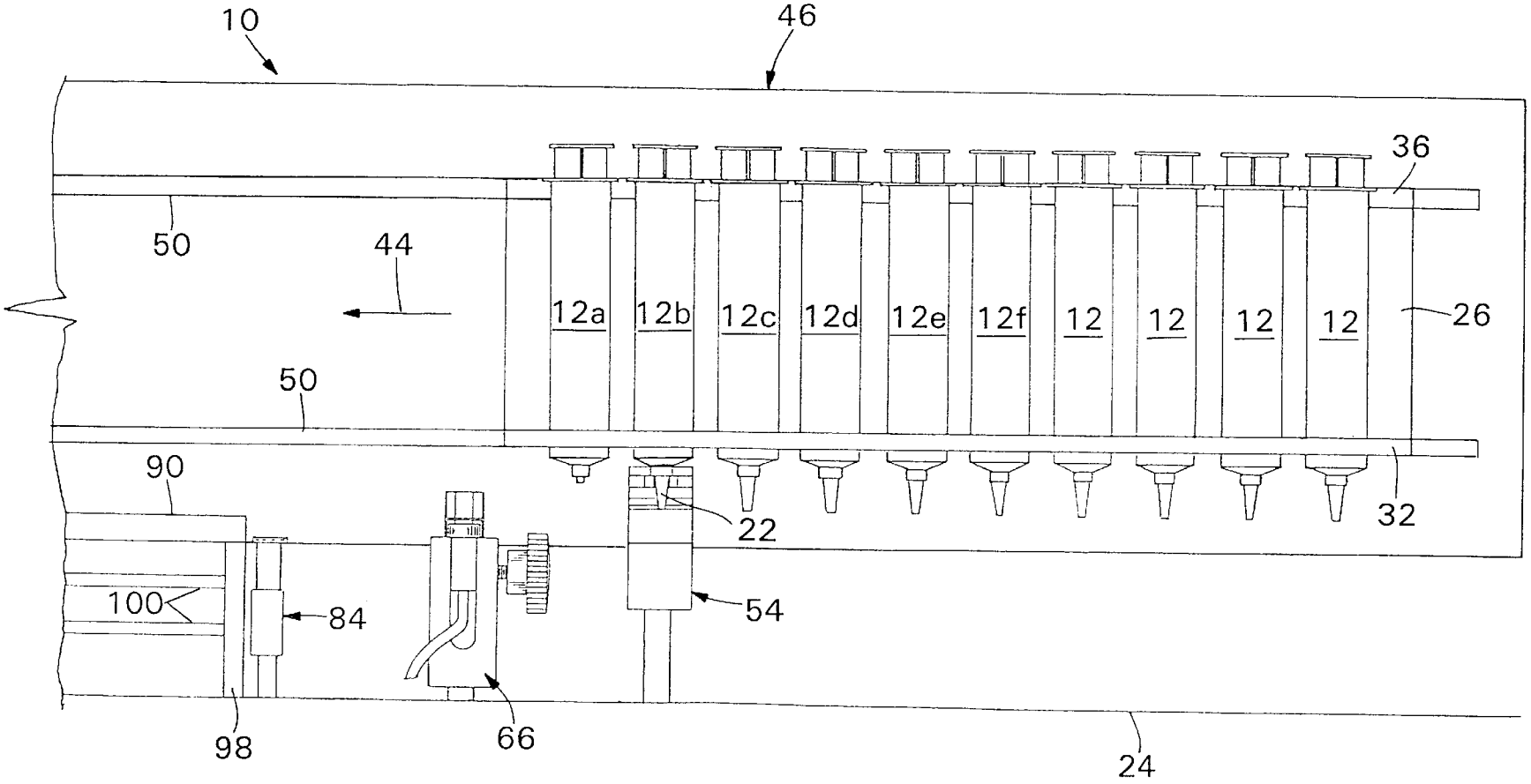
Figure 7D:
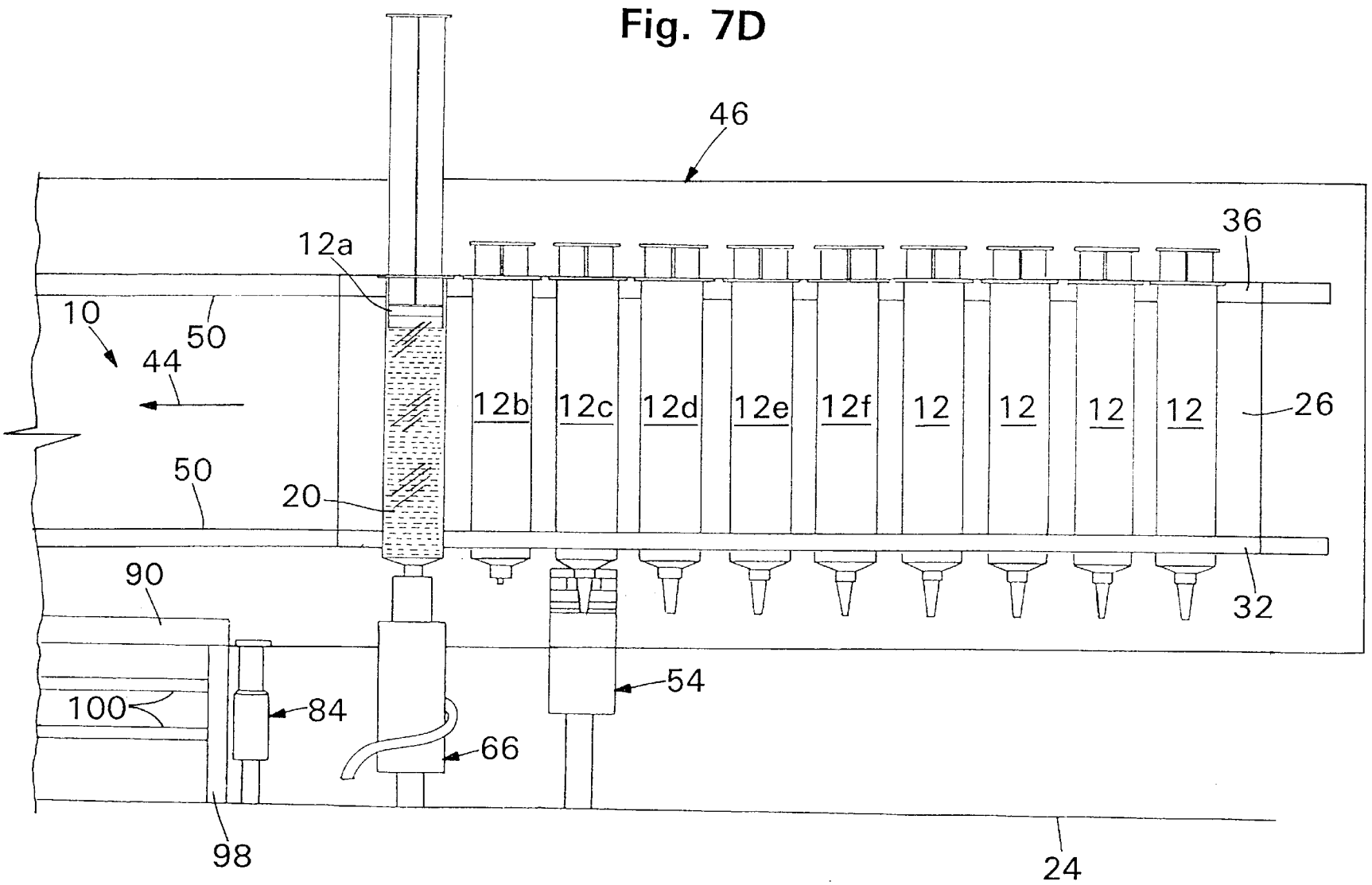

When the sterile delivery device filling machine 10 is set in operation, it automatically feeds a plurality of the sterile delivery devices 12 along the predetermined path 44. That is, the feeding magazine 26 holding a plurality of the sterile delivery devices 12 is fed along the predetermined path 44 in an indexed manner. With reference to FIG. 7B, the feeding magazine 26 is moved along the predetermined path 44 a distance equivalent to the center line spacing between two sterile delivery devices 12 (hereinafter referred to as "one indexed distance"), such that the first sterile delivery device 12*a* is positioned over the tip removing station 54 for removing the tips 22 from the dispensing nozzles 16 of the sterile delivery devices 12. The tip 22 is removed from the dispensing nozzle 16 of the first sterile delivery device 12*a* in the manner described above in connection with FIGS. 2A through 2D. Once the tip 22 has been removed from the first sterile delivery device 12*a,* the controller actuates the magazine drive motor 52 to move the feeding magazine 26 one indexed distance, as shown in FIG. 7C. When the feeding magazine 26 is in the position shown in FIG. 7C, the tip removing station 54 carries out its operation on the second sterile delivery device 12*b*. Once this operation is complete, the feeding magazine 26 is then driven one indexed distance by the magazine drive motor 52 such that the first sterile delivery device 12*a* is positioned over the fluid filling station 66, the second sterile delivery device 12*b* is positioned between the fluid filling station 66 and the tip removing station 54, and the third sterile delivery device 12*c* is located above the tip removing station 54, as shown in FIG. 7D. In this position, the fluid filling station 66 fills the first sterile delivery device 12*a* with fluid 20 and the tip 22 is removed from the third sterile delivery device 12*c* by the tip removing station 54 as described above in connection with FIGS. 2A to 2D and 3A to 3C.

Figure 7E:
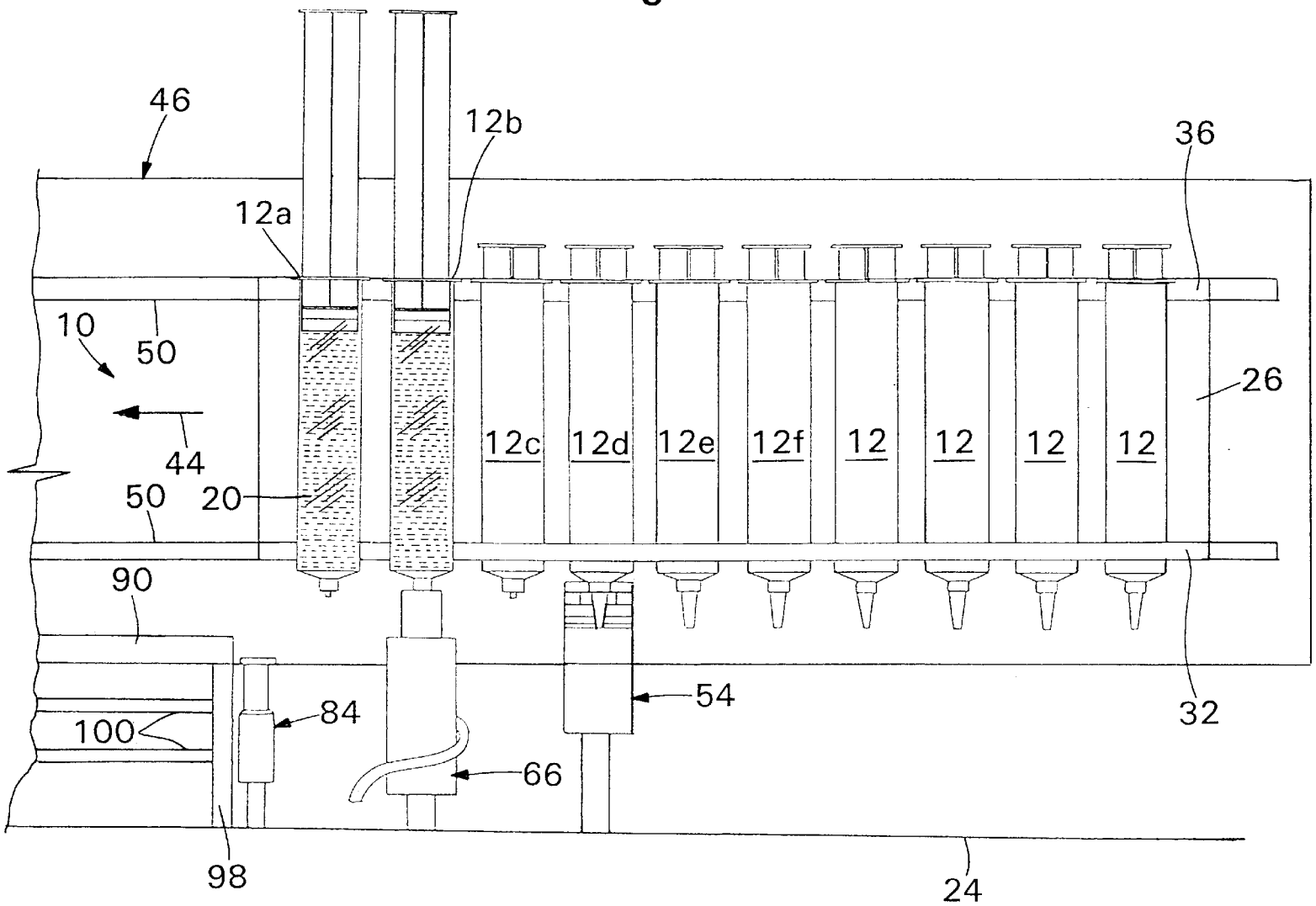
Figure 7F:
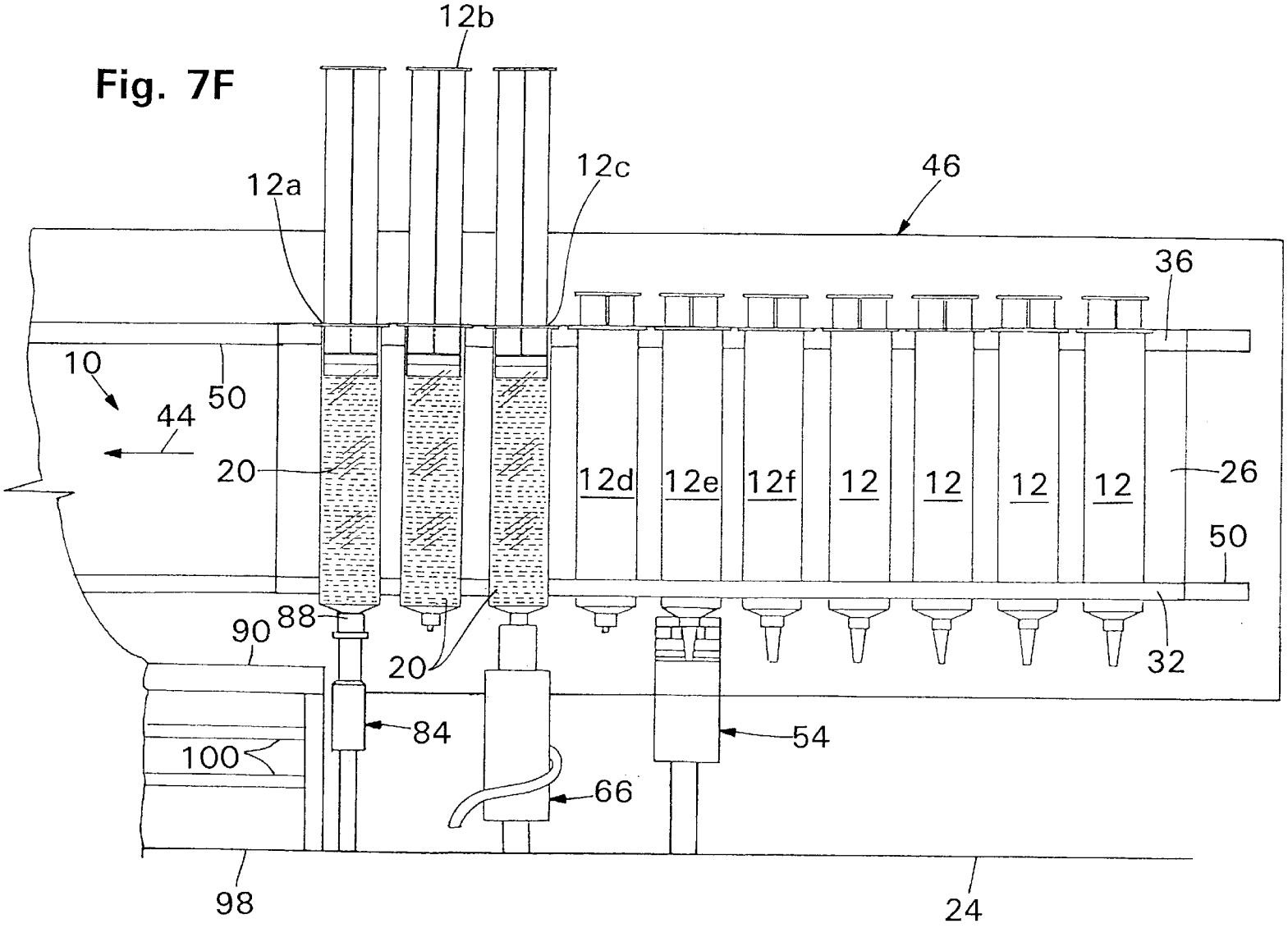

Next, the feeding magazine 26 is driven one indexed distance by the magazine drive motor 52 such that the first sterile delivery device 12*a* is positioned between the fluid filling station 66 and the sealing station 84, the second sterile delivery device 12*b* is positioned above the fluid filling station 66, the third sterile delivery device 12*c* is positioned between the fluid filling station 66 and the tip removing station 54 and the fourth sterile delivery device 12*d* is positioned over the tip removing station 54, as described in FIG. 7E. In this position, the tip removing station 54 removes a tip from the fourth sterile delivery device 12*d* and the second sterile delivery device 12*b* is filled with the desired quantity of fluid 20 in the manner described above.

Figure 7G:
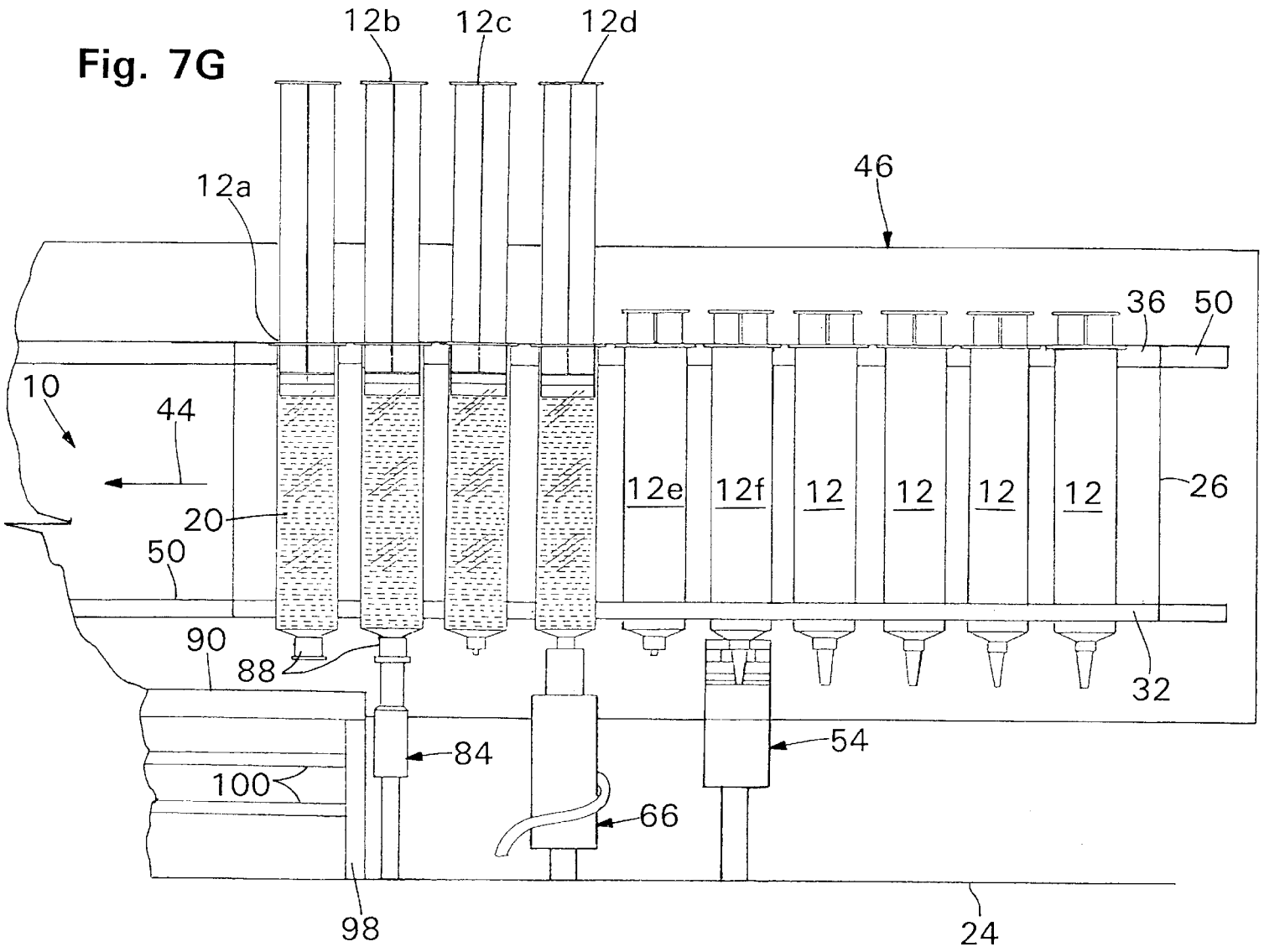

Next, the controller 60 actuates the magazine drive motor 52 to drive the feeding magazine 26 one indexed distance such that the first sterile delivery device 12*a* is positioned over the sealing station 84, the second sterile delivery device 12*b* is positioned between the sealing station 84 and fluid filling station 66, the third sterile delivery device 12*c* is positioned over the fluid filling station 66, the fourth sterile delivery device 12*d* is positioned between the fluid filling station 66 and the tip removing station 54 and the fifth sterile delivery device 12*e* is positioned above the tip removing station 54. The sealing station 84, fluid filling station 66 and tip removing station 54 are then actuated as described above to carry out their respective functions. The controller 66 then actuates the magazine drive motor 52 to move the feeding magazine 26 one indexed distance, as shown in FIG. 7G, and this is repeated until all of the sterile delivery devices 12 have been filled with the fluid 20 and have been sealed with caps 88.

The steps of removing tips 22 from the sterile delivery devices 12 and sealing the filled sterile delivery devices 12, depending upon the amount of quantity of fluid 20 to be filled within the sterile delivery devices 12, will often be completed before the sterile delivery devices 12 are filled with the desired quantity of fluid 20. Thus, the magazine drive motor 52 does not index the feeding magazine 26 until all of the steps are carried out by the tip removing station 54, fluid filling station 66 and sealing station 84.

As is apparent from the foregoing description, the sealing station 84 carries out the function of closing and sealing the dispensing nozzle 16 of the sterile delivery devices 12 after the filling step in the fluid filling station 66 to provide sealed sterile delivery devices 12 with sterile fluid contents 20. It is also apparent that the steps of removing the tip 22, filling the sterile delivery devices with fluid 20 and sealing the sterile delivery devices with a cap 88 are carried out consecutively with respect to each individual sterile delivery device 12. Moreover, it is apparent that each of these steps is carried out at least partially simultaneously with respect to at least three sterile delivery devices 12. These steps are carried out partially simultaneously because, as mentioned above, the tip removing station 54 and the sealing station 84 may complete their functions prior to the fluid filling station 66 completing filling a particular sterile delivery device 12 with a quantity of fluid 20.

It is apparent from the foregoing description that the sterile delivery device filling machine 10 can be used for automatically mass producing prebilled, sterile delivery devices 12 and distributing the filled sterile delivery devices 12 to dispensing stations 102 (see FIG. 1). That is, by providing a parenteral medical material in dry, powder form and mixing the medical material with a diluent to form a parenteral fluid which becomes the fluid source 82 for the sterile delivery device filling machine 10, the sterile delivery device filling machine 10 can be used to mass produce prebilled, sterile delivery devices 12. Once the sterile delivery devices 12 are filled, they can be shipped to one or more of the dispensing stations 102. Dispensing stations, as used herein, are typically pharmacies which mix and dispense medicaments. In this manner, the pharmacy is saved a significant amount of time in having to mix the parenteral fluid and fill delivery devices.

In the present embodiment, it is preferred that about 0.5 kilograms of parenteral medical material in powder form be supplied in 5 liter bags (not shown) and then mixed with a diluent to form a parenteral fluid. This is a significant improvement over the conventional method of shipping and dispensing parenteral medical materials in powder form which are distributed in small vials, each of which requires reconstitution and then mixing into a larger bag or container. It is understood by those of ordinary skill in the art from this disclosure that the present invention is not limited to the use of 0.5 kilograms in a 5 liter bag in that other large volumes could be used, in the range from 0.25 to 5 kilograms of powdered medicament in 2.5 to 50 liter containers.

It is understood by those of ordinary skill in the are that the foregoing sterile delivery device filling machine 10 is typically used under a laminar flow hood to minimize the risk of microbial contaminants entering the fluid 20. To this end, it is also preferred that the sterile delivery devices 12 be filled from the dispensing nozzle end 16 to further minimize the possibility of microbial contamination.

From the foregoing description of the preferred embodiment, it can be seen that the present invention provides a sterile delivery device filling machine 10 which can mass produce prebilled, sterile delivery devices which can be distributed to dispensing stations to minimize intensive manual labor performed by pharmacists. It will be appreciated by those skilled in the art that changes could be made to the embodiment described above without departing from the broad inventive concept thereof. For instance, the present invention is not limited to the pharmaceutical industry, and is useful in other industries which package materials in syringe type delivery devices. In addition, it is understood by those of ordinary skill in the art that while the feeding magazine is fed horizontally and the tip removing station 54, fluid filling station 66 and sealing station 84 move vertically into engagement with the sterile delivery devices 12, the feeding magazine 26 could move vertically as well, and the tip removing station 54, fluid filling station 66 and sealing station 84 could remain vertically stationary.

What is claimed is:

1. A method of automatically producing a plurality of prefilled, sterile delivery devices, the sterile delivery devices each including a hollow barrel with a dispensing nozzle at one end and an open opposite end, a piston plunger positioned within the open end and slidable in sealing engagement with the barrel to retain a fluid therein and a tip secured to the dispensing nozzle, the method comprising the steps of:

(a) automatically feeding a plurality of the sterile delivery devices along a predetermined path;

(b) removing the tips from the dispensing nozzles of the sterile delivery devices;

(c) filling the hollow barrels of the sterile delivery devices through the dispensing nozzles with a desired quantity of fluid; and (d) closing and sealing the dispensing nozzles of the sterile delivery devices after the filling step to provide sealed sterile delivery devices with sterile fluid contents.

2. The method as recited in claim 1 wherein steps (b), (c) and (d) are carried cut consecutively with respect to each individual sterile delivery device.

3. The method as recited in claim 2 wherein steps (b), (c) and (d) are carried out at least partially simultaneously with respect to at least three sterile delivery devices.

4. The method as recited in claim 1 wherein step (d) further comprises securing a cap to each dispensing nozzle of the sterile delivery devices.

5. The method as recited in claim 4 wherein the tip is secured to the nozzle using a twist on connection and step (d) further comprises securing a cap to each dispensing nozzle of the sterile delivery devices by rotating said cap onto the dispensing nozzle.

6. The method as recited in claim 1 wherein in step (c) the plunger moves within the hollow barrel as the hollow barrel is filled with the fluid.

7. The method as recited in claim 1 wherein the tip is secured to the nozzle using a twist on connection and step (b) comprises grasping and rotating each tip to remove the tips from the dispensing nozzles of the sterile delivery devices.

8. The method as recited in claim 1 wherein step (a) comprises feeding a magazine holding a plurality of the sterile delivery devices along a predetermined path and steps (b), (c) and (d) are carried out with the sterile delivery devices held by the magazine.

9. The method as recited in claim 1 further comprising feeding the sterile delivery devices to a filling station after step (b) and step (c) is carried out at said filling station.

10. The method as recited in claim 9 further comprising feeding the filled sterile delivery devices to a sealing station after step (c) and step (d) is carried out at said sealing station.

11. The method as recited in claim 1 wherein in step (c) the sterile delivery devices are in an inverted position such that as fluid flows into the hollow barrel the hollow barrel fills from the dispensing nozzle to the open end.

12. An apparatus for automatically producing a plurality of prefilled, sterile delivery devices, the sterile delivery devices each including a hollow barrel with a dispensing nozzle at one end and an open opposite end, a piston plunger positioned within the open end and slidable in sealing engagement with the barrel to retain a fluid therein and a tip secured to the dispensing nozzle, the apparatus comprising:

(a) a predetermined feeding path configured to receive and move a plurality of the sterile delivery devices along said predetermined feeding path;

(b) a tip removing station positioned proximate said predetermined feeding path for removing the tips from the dispensing nozzles of the sterile delivery devices by engaging and removing a tip from a sterile delivery device as the sterile delivery devices move along said predetermined feeding path;

(c) a fluid filling station positioned proximate said predetermined feeding path for filling the hollow barrels of the sterile delivery devices through the dispensing nozzles with a desired quantity of fluid, said fluid filling station including a discharge end in fluid communication with a pump and being configured for complementary sealed engagement with the dispensing nozzles of the sterile delivery devices, said discharge end being movable between a first position wherein said discharge end is spaced from said sterile delivery devices and a second position wherein said discharge end is in complementary sealed engagement with a dispensing nozzle of a sterile delivery device for passing fluid to the hollow barrel of the sterile delivery device as the sterile delivery devices move along said predetermined feeding path; and (d) a sealing station positioned proximate said predetermined feeding path for closing and sealing a dispensing nozzle of the sterile delivery device having fluid located in the hollow barrel to provide sealed sterile delivery devices with sterile fluid contents, said sealing station including a plurality of caps each being complementarily sized to seal the dispensing nozzle of the sterile dispensing devices, said sealing station securing said caps in complementary sealed engagement with the dispensing nozzles of the sterile dispensing devices to seal the fluid within the hollow barrel of the sterile dispensing device as said sterile delivery devices move along said predetermined feeding path.

13. The apparatus as recited in claim 12 further comprising a magazine for holding a plurality of the sterile delivery devices, said magazine being disposed on and moveable along said predetermined feeding path.

14. The apparatus as recited in claim 13 further including a motor operably associated with said magazine for moving said magazine along said predetermined feeding path with respect to the tip removing station, fluid filling station and sealing station in an indexed manner to pass each sterile delivery device in the magazine through said tip removing station, fluid filling station and sealing station whereby sealed sterile delivery devices with sterile fluid contents are located within said magazine after said magazine moves along said predetermined feeding path past said tip removing station, fluid filling station and sealing station.

15. The apparatus as recited in claim 12 wherein said tip removing station includes a movable gripping arm which engages and removes the tip from the sterile delivery device.

16. The apparatus as recited in claim 15 wherein the tip is secured to the nozzle using a twist on connection and said gripping arm grasps and rotates each tip to remove the tips from the dispensing nozzles of the sterile delivery devices.

17. The apparatus as recited in claim 12 wherein said fluid filling station further comprises a filling tube having a first end in fluid communication with said pump such that fluid dispensed by said pump flows into said filling tube and a second end which forms said discharge end of said pump.

18. The apparatus as recited in claim 12 wherein said sealing station further includes a movable pick up rod having a terminal end with a cap thereon, said pick up rod being movable between a first position wherein said terminal end is spaced from the said sterile delivery devices and a second position wherein said terminal end positions said cap in complementary sealed engagement with a dispensing nozzle of a sterile dispensing device to seal the fluid within the hollow barrel of the sterile dispensing device as said sterile delivery devices move along said predetermined feeding path.

19. The apparatus as recited in claim 18 wherein the tip is secured to the nozzle using a twist on connection and said pick up rod rotates said cap onto each dispensing nozzle of the sterile delivery devices.

20. The apparatus as recited in claim 12 wherein the sterile delivery devices are in an inverted position on said predetermined feeding path such that as fluid flows into the hollow barrel the hollow barrel fills from the dispensing nozzle to the open end.

21. A method of automatically mass producing prefilled, sterile delivery devices and distributing the filled sterile delivery devices to dispensing stations, the sterile delivery devices each including a hollow barrel with a dispensing nozzle at one end and an open opposite end, a piston plunger positioned within the open end and slidable in sealing engagement with the barrel to retain a fluid therein and a tip secured to the dispensing nozzle, the method comprising the steps of:

(a) providing a parenteral medical material in powder form;

(b) mixing said medical material with a diluent to form a parenteral fluid;

(c) automatically feeding a plurality of the sterile delivery devices along a predetermined path;

(d) removing the tips from the dispensing nozzles of the sterile delivery devices as the sterile delivery devices move along a predetermined path;

(e) filling the hollow barrels of the sterile delivery devices through the dispensing nozzles with a desired quantity of said parenteral fluid as the sterile delivery devices move along a predetermined path;

(f) closing and sealing the dispensing nozzles of the sterile delivery devices after the filling step to provide sealed sterile delivery devices with sterile fluid contents; and (g) shipping said sealed sterile delivery devices with sterile fluid contents to one or more dispensing stations.

* * * * *